US005964191A

United States Patent [19]

Hata

[11] Patent Number: 5,964,191

[45] Date of Patent: Oct. 12, 1999

[54] REVERSE ROTATION CONTROL SYSTEM FOR TWO-CYCLE ENGINE OF MOTOR VEHICLE

[75] Inventor: Toshiaki Hata, Hyogo, Japan

[73] Assignee: Mitsubishi Denki Kabushiki Kaisha, Tokyo, Japan

[21] Appl. No.: 09/132,468

[22] Filed: Aug. 11, 1998

[30] Foreign Application Priority Data

Feb. 5, 1998 [JP] Japan ..... 10-024491

[51] Int. Cl.[6] ..... F01L 13/02

[52] U.S. Cl. ..... 123/41 E; 123/41 R; 123/406.14; 123/65 R

[58] Field of Search ..... 123/41 R, 41 E, 123/65 R, 406.14

[56] References Cited

U.S. PATENT DOCUMENTS 5,036,802 8/1991 D'Amours .
5,782,210 7/1998 Venturoli et al. ..... 123/41 E
5,794,574 8/1998 Bostelmann ..... 123/41 E

*Primary Examiner*—Henry C. Yuen
*Assistant Examiner*—Hai Huynh
*Attorney, Agent, or Firm*—Sughrue, Mion, Zinn, Macpeak & Seas, PLLC

[57] ABSTRACT

A reverse rotation control system for a two-cycle engine of a motor vehicle which can be implemented inexpensively while preventing exhaust gas from degradation. The system includes a variety of sensors for generating signals corresponding to engine operation states, and an ignition control unit (10A) for generating an ignition signal (P) on the basis of the various signals. The sensors include a rotation sensor (6) for generating a rotation signal (SG) indicating engine rotation number (Re) and a reverse rotation switch (23) for generating a reverse rotation command signal (RW). The ignition control unit (10A) includes a means for causing the rotation number (Re) of the engine (1) to be lowered to a first predetermined engine rotation number (ReW1) through ignition timing retarding control upon inputting of the reverse rotation command signal, a means for arithmetically determining on the basis of engine state a timer period (TM) over which misfire is caused to occur successively, a means for causing the misfire to occur only for the timer period (TM) from the first predetermined engine rotation number (ReW1) to a second predetermined engine rotation number (ReW2), and a means for outputting only once an overadvanced ignition signal upon termination of the timer period (TM) which corresponds to a time taken for the engine rotation number (Re) to lower to the second predetermined engine rotation number (ReW2) during the misfire control.

10 Claims, 4 Drawing Sheets

REVERSE ROTATION CONTROL SYSTEM FOR TWO-CYCLE ENGINE OF MOTOR VEHICLE

BACKGROUND OF THE INVENTION

1. Field of the Invention

The present invention generally relates to a reverse rotation control system for a two-cycle engine which makes it possible to drive or run a motor vehicle equipped with the two-cycle engine exchangeably in forward or rearward direction by reversing the rotation of the engine. More particularly, the invention is concerned with a reverse rotation control system for a two-cycle engine mounted on a motor vehicle, which system can realize a reverse rotation control with inexpensive hardware structure without incurring degradation with regard to exhaust gas composition and ignition performance of the motor vehicle equipped with the two-cycle engine.

2. Description of Related Art

In general, a four-cycle engine mounted on a motor vehicle such as a passenger car is equipped with a clutch and a gear box at the output side of the engine for deriving the output power thereof.

However, in the case of small-size motor vehicles for specific purposes such as snowmobiles, all-terrain vehicles and the like, a two-cycle engine of an inexpensive structure is mounted. In this conjunction, it is further noted that in these motor vehicles, the space for installing or accommodating the engine is limited.

Such being the circumstances, no gear box is ordinarily installed as the reverse rotation control system for the two-cycle engine in these types of the motor vehicles, wherein the output torque of the engine is derived through the medium of only a centrifugal-type automatic transmission implemented in the form of a V-belt transmission.

Consequently, the motor vehicle can be driven only in the forward direction. Thus, manpower is required for moving the motor vehicle backwards or rearwards as in the case where the motor vehicle is to be taken out from a garage or it is to be disburden from a carrier such as a lorry, giving rise to a problem that the motor vehicle is very inconvenient to handle.

For evading the problem mentioned above, it has heretofore been proposed that a clutch and a gear box are provided also for the motor vehicle equipped with the two-cycle engine by affording a sufficient space for installation of the two-cycle engine so that the traveling direction of the motor vehicle can be changed over between the forward direction and the backward or rearward direction by manipulating a gear change lever, as in the case of the four-cycle engine.

For having a better understanding of the concept underlying the present invention, a hitherto-known or conventional reverse rotation control system for a two-cycle engine of a motor vehicle will be reviewed in some detail.

FIG. 4 is a block diagram showing schematically and generally a configuration of a prior art reverse rotation control system for a two-cycle engine of a motor vehicle in which a conventional gear box is employed. Referring to FIG. 4, an internal combustion engine (hereinafter referred to simply as the engine) 1 driven in two cycles is installed on a motor vehicle (not shown). The engine 1 has an output shaft 2 which rotates in one direction as indicated by an arrow, wherein a driving torque generated by the engine 1 is outputted through the medium of a clutch 3 and a gear box 4. The gear box 4 is provided with a back gear train for allowing the motor vehicle to be driven rearwards.

Furthermore, a change lever 5 is provided in the gear box 4 for allowing a driver to manually change over gear trains. A rotation sensor 6 for detecting the engine speed (rpm) as well the as angular position of a crank shaft (crank angle) of the engine is implemented in the form of an electromagnetic pickup device or the like and provided in association with the output shaft of the engine 1. A rotation signal SG derived from the output of the rotation sensor 6 is inputted to an ignition control unit 10 which may be constituted by a microprocessor or microcomputer.

The ignition control unit 10 is so designed or programmed as to arithmetically determine control timings for the engine 1 for issuing an ignition signal P on the basis of operation state information which can be derived from not only the rotation signal SG mentioned above but also other signals outputted from other various sensors (not shown).

An ignition coil 11 is realized in the form of a transformer having a primary winding and a secondary winding for generating in response to the ignition signal P a secondary voltage boosted up upon interruption of the primary current, whereby a high voltage for firing is applied to a spark plug 12 of the engine 1. In this conjunction, it is to be noted that the engine 1 is subjected to rotation control in a predetermined direction by controlling the ignition timing on the basis of the rotation signal SG.

In the two-cycle engine of a motor vehicle equipped with the conventional reverse rotation control system such as shown in FIG. 4, the rotation output or output torque of the engine 1 can be reduced as desired through the gear box 4 while the driving direction of the motor vehicle can be changed over between the forward direction and the rearward direction with the aid of the back gear train.

However, with the arrangement shown in FIG. 4, difficulty will be encountered in assuring a space around the engine 1 for affording accommodation and installation of the gear box 4. In particular, in the case of the snowmobile and the all-terrain vehicle mentioned previously, it is difficult to make available an engine room for accommodating therein the engine 1 itself. Consequently, additional provision of the gear box 4 will incur remarkable increase in the manufacturing cost of the motor vehicle.

At this juncture, it should be mentioned that the two-cycle engine has such a feature that the crank shaft can be rotated in any one of the forward or reverse direction by selectively controlling the ignition timing, differing from the four-cycle engine.

In actuality, a reverse rotation control system for a two-cycle engine has been realized by making use of the above-mentioned feature. By way of example, there is disclosed in U.S. Pat. No. 5,036,802 issued in 1991 such a reverse rotation control system for a two-cycle engine of a motor vehicle which makes it possible to drive the motor vehicle either in the forward direction or the rearward direction through the reverse rotation control of the engine 1 by using a centrifugal-type automatic transmission (not shown) without resorting to the use of the gear box 4.

In this case, when a driving direction of a motor vehicle equipped with a two-cycle engine is to be reversed, a driver manipulates a rotation reversing lever in a normal rotation state of the engine 1 (corresponding to e.g. forward traveling of the motor vehicle). Then, the ignition control unit 10 lowers the rotation speed (rpm) of the engine 1 by forcibly causing misfire to take place in the engine 1. When the engine rotation speed has thus been lowered to a second predetermined engine rotation speed (e.g. 500 rpm) which is suited for the reverse rotation control (i.e., control for reversing the rotating direction of the engine), the ignition timing at which the ignition signal P is applied is caused to overadvance beyond a normal advance control position (lying within a range of 5° to 30° before the top dead center TDC in terms of crank angle, i.e., BTDC 5° to 30°). With the overadvance control for the ignition timing described above, the ignition timing is set, for example, at BTDC 40° (i.e., at the crank angle of 40° before the top dead center or BTDC 40°), to thereby allow the engine 1 to transit from the normal rotation state (corresponding to e.g. forward running of the motor vehicle) to the reverse rotation state (corresponding to e.g. rearward traveling direction of the motor vehicle).

Thereafter, the ignition control unit 10 regards the reverse rotation direction as the normal rotation direction and the ignition signal P is generated at the ordinary ignition timing for sustaining continuously the reverse rotation state of the engine 1. Thus, the motor vehicle can be driven rearwards. Parenthetically, when the engine 1 is to be restored from the reverse rotation state to the normal rotation state, the control process similar to that described above is carried out by regarding the current rotating direction of the engine (i.e., the reverse rotation) as the normal rotating direction.

With the reverse rotation control system described above, there arises the necessity for monitoring or detecting constantly the rotation number of the engine 1 in order to decide that the engine rotation number has actually decreased to the second predetermined engine rotation number which permits the reverse rotation by comparing the detected engine rotation number with the second predetermined engine rotation number, as a result of which not only the cost of the engine system but also the burden imposed on the ignition control unit 10 increases.

Certainly, the manufacturing cost of the motor vehicle can be reduced because the gear box 4 can be spared. However, because the engine rotation number or engine speed (rpm) is lowered to the second predetermined engine rotation number at which the rotation of the engine 1 can be reversed by resorting to the misfire control technique described above, unburnt gas is discharged from the engine 1 during the misfire control process, giving rise to a problem. Furthermore, during the misfire control process, deposition of fuel components on a discharge electrode of the spark plug 12 is likely to occur, as a result of which ignition performance of the engine 1 will be degraded at a succeeding ignition timing, to a disadvantage.

As can be understood from the foregoing, the conventional reverse rotation control system for the two-cycle engine for a motor vehicle suffers a problem that when the gear box 4 such as shown in FIG. 4 is employed, there arises the necessity for ensuring a space for installation of the gear box 4 around the engine 1, which will of course lead to increasing of the cost.

On the other hand, in the reverse rotation control system for the engine 1 in which the engine rotation number is once lowered and then the ignition timing is overadvanced, as is disclosed in U.S. Pat. No. 5,036,802, there arises the necessity for monitoring the engine rotation speed (rpm) up to a time point immediately before the start of the overadvanced ignition timing control in order to decide that the engine rotation number has decreased to the second predetermined engine rotation number suited for the rotation reversing control. Thus, the burden imposed on the ignition control unit 10 increases, being accompanied with increase of the cost of the motor vehicle. Additionally, the quality of exhaust gas composition and the firing performance will be degraded during the misfire control process, giving rise to another problem.

SUMMARY OF THE INVENTION

In the light of the state of the art described above, it is an object of the present invention to provide a low-cost reverse rotation control system for a two-cycle engine of a motor vehicle, which can decrease the engine rotation number while ensuring desirable exhaust gas composition and ignition performance during the reverse rotation control without need for provision of the gear box and without necessity of monitoring constantly the engine rotation number.

In view of the above and other objects which will become apparent as the description proceeds, there is provided according to a general aspect of the present invention a reverse rotation control system for a two-cycle engine mounted on a motor vehicle, which system includes a variety of sensors for generating a variety of information signals in correspondence to engine operation states, and an ignition control unit for outputting an ignition signal for the engine on the basis of the variety of information signals. The variety of sensors includes at least a rotation sensor for outputting a rotation signal corresponding to rotation of the engine and a reverse rotation switch for generating a reverse rotation command signal for reversing the engine rotation. The ignition control unit includes an ignition timing retarding control means for causing ignition timing of the engine to retard beyond a top dead center upon inputting of the reverse rotation command signal, an engine rotation number decision means for deciding whether or not rotation number of the engine is lowered to a first predetermined engine rotation number, a misfire period arithmetic means for determining arithmetically a misfire period on the basis of the engine operation states when the engine rotation number is lowered to a first predetermined engine rotation number, a misfire means for causing misfire to occur in the engine over the misfire period, and an overadvanced ignition means for outputting only once an ignition signal overadvanced relative to an ordinary advanced ignition timing upon termination of the misfire period. In that case, the misfire period corresponds to a time period required for the engine rotation number to lower from the first predetermined engine rotation number to a second predetermined engine rotation number, wherein the first predetermined engine rotation number is set at a value smaller than an idling rotation number of the engine, while the second predetermined engine rotation number is set at a value which is smaller than the first predetermined engine rotation number and which is suited for the reverse rotation control.

By virtue of the arrangement described above, there can be realized a low-cost reverse rotation control system for a two-cycle engine of a motor vehicle, which can decrease the engine rotation number while ensuring desirable exhaust gas composition and ignition performance during the reverse rotation control without need for provision of the gear box and in which the period for monitoring the engine rotation number can be shortened.

In a preferred mode for carrying out the invention, the ignition timing retarding control means may be so designed or programmed as to make the ignition timing retard by a crank angle of 0° to 30° from the top dead center.

Owing to the arrangement described above, the rotation speed (rpm) of the two-cycle engine can be lowered to a first predetermined engine rotation number with high reliability.

In another preferred mode for carrying out the invention, the misfire period arithmetic means may be so designed as to determine arithmetically a timer period as the misfire period for allowing misfire to occur in continuation, with the misfire control means being designed to cause misfire to occur in the engine over the timer period.

With the arrangement described above, the engine rotation number can be lowered to the second predetermined rotation number without incurring any appreciable increase of cost.

In yet another preferred mode for carrying out the invention, the misfire period arithmetic means may be so designed as to determine arithmetically a number of times misfire is to occur as the misfire period with the misfire control means being designed to cause misfire to occur in the engine only the determined number of times.

With the arrangement described above, there can be realized the reverse rotation control system in which the engine rotation number can be lowered to the second predetermined rotation number without incurring any appreciable increase of cost.

In still another preferred mode for carrying out the invention, the ignition control unit may be composed of a reverse rotation condition decision means for making decision upon inputting of the reverse rotation command signal as to whether or not the engine operation state satisfies reverse rotation enabling conditions, wherein the ignition timing retarding control means is validated only when the reverse rotation enabling conditions are satisfied.

With the arrangement described above, enhanced maneuverability of the motor vehicle equipped with the reverse rotation control system can be ensured during the reverse rotation control.

In a further preferred mode for carrying out the invention, the various sensors may include a brake switch for generating a brake signal upon braking operation and an idle switch for generating an idle signal when an acceleration pedal is released, wherein the reverse rotation enabling condition decision means may be so designed as to decide that the reverse rotation enabling conditions are met when the engine rotation number indicates an engine rotation number corresponding to the idling rotation number and when both of the brake signal and the idle signal are inputted.

With the arrangement described above, maneuverability of the motor vehicle during the reverse rotation control can equally be enhanced.

In a yet further preferred mode for carrying out the invention, the various sensors may further include a temperature sensor for outputting a temperature information signal indicating temperature of the engine, wherein the misfire period arithmetic means may be so designed as to determine arithmetically the misfire period on the basis of the rotation signal and the temperature information signal.

With the arrangement described above, the engine rotation number can be converged to the second predetermined rotation number with high accuracy.

In a still further preferred mode for carrying out the invention, the ignition control unit may be so implemented as to include a normal ignition means for outputting a normal ignition signal in succession to an excessively advanced or overadvanced ignition signal generated by the overadvanced ignition signal generating means, a reverse rotation decision means for deciding whether or not the engine is in a reverse rotation state at the time point when the normal ignition signal is outputted, and a reverse rotation repeating means for executing repetitively reverse rotation control processing for the engine until the reverse rotation state is validated.

By virtue of the arrangement described above, there can be realized a reverse rotation control system for a two-cycle engine which can reverse the rotation of the engine with much enhanced reliability.

In a further preferred mode for carrying out the invention, the reverse rotation repeating means may include a counter means for counting a number of times the reverse rotation control processing is repeated, wherein the reverse rotation control processing is terminated at a time point when the repeating number has attained a predetermined number.

Owing to the arrangement described above, repetitive execution of the reverse rotation control in vain can be avoided.

In a yet further preferred mode for carrying out the invention, the reverse rotation control system mentioned above may further include a normal rotation indicating lamp and a reverse rotation indicating lamp, wherein both the lamps are driven under the control of the ignition control unit such that the normal rotation indicating lamp is energized only when the engine is rotating in a normal direction, while the reverse rotation indicating lamp is lit only when the engine is rotating in a reverse direction.

With the arrangement described above, visibly recognizable information as to the current running state of the motor vehicle can be made available for the driver of the motor vehicle.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
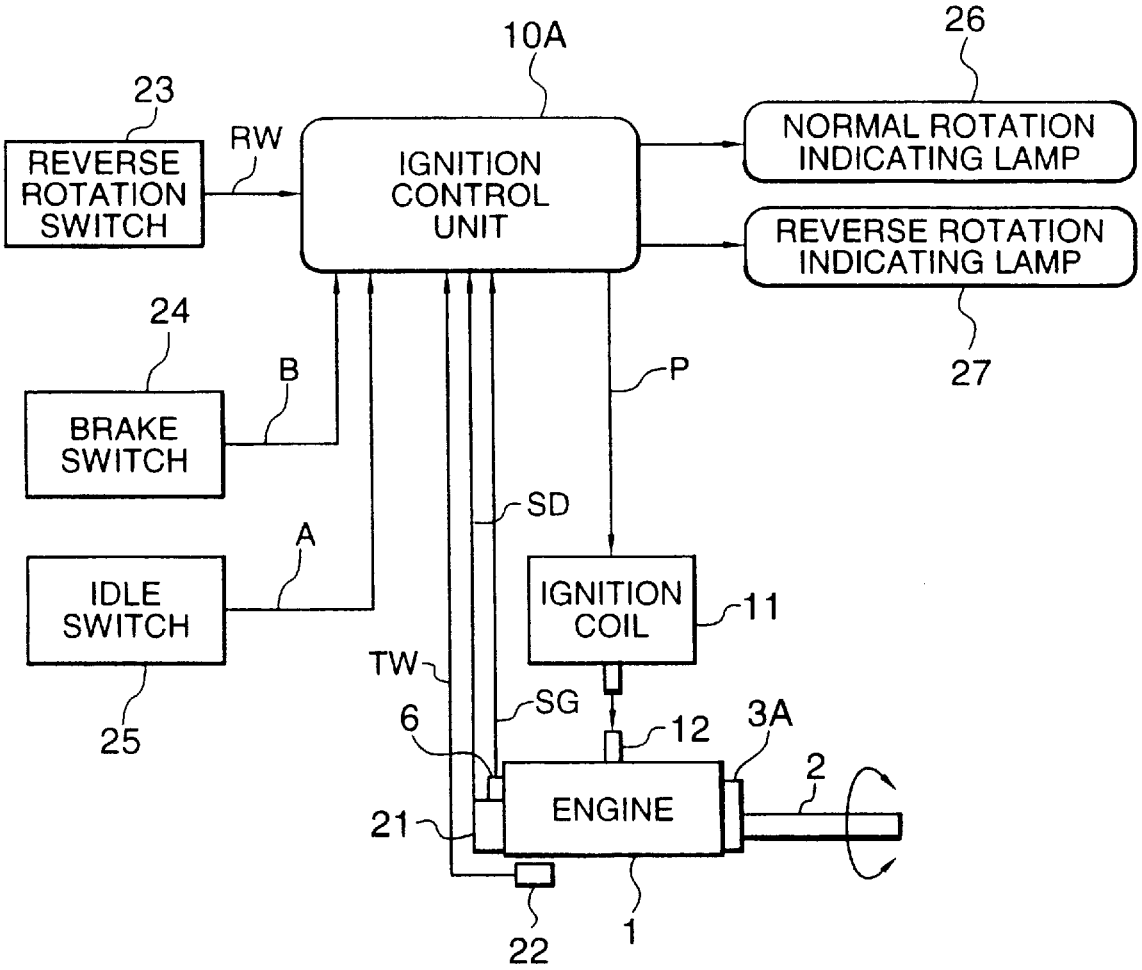
FIG. 1 is a block diagram showing generally an arrangement of a reverse rotation control system for a two-cycle engine of a motor vehicle according to an embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

Figure 4:
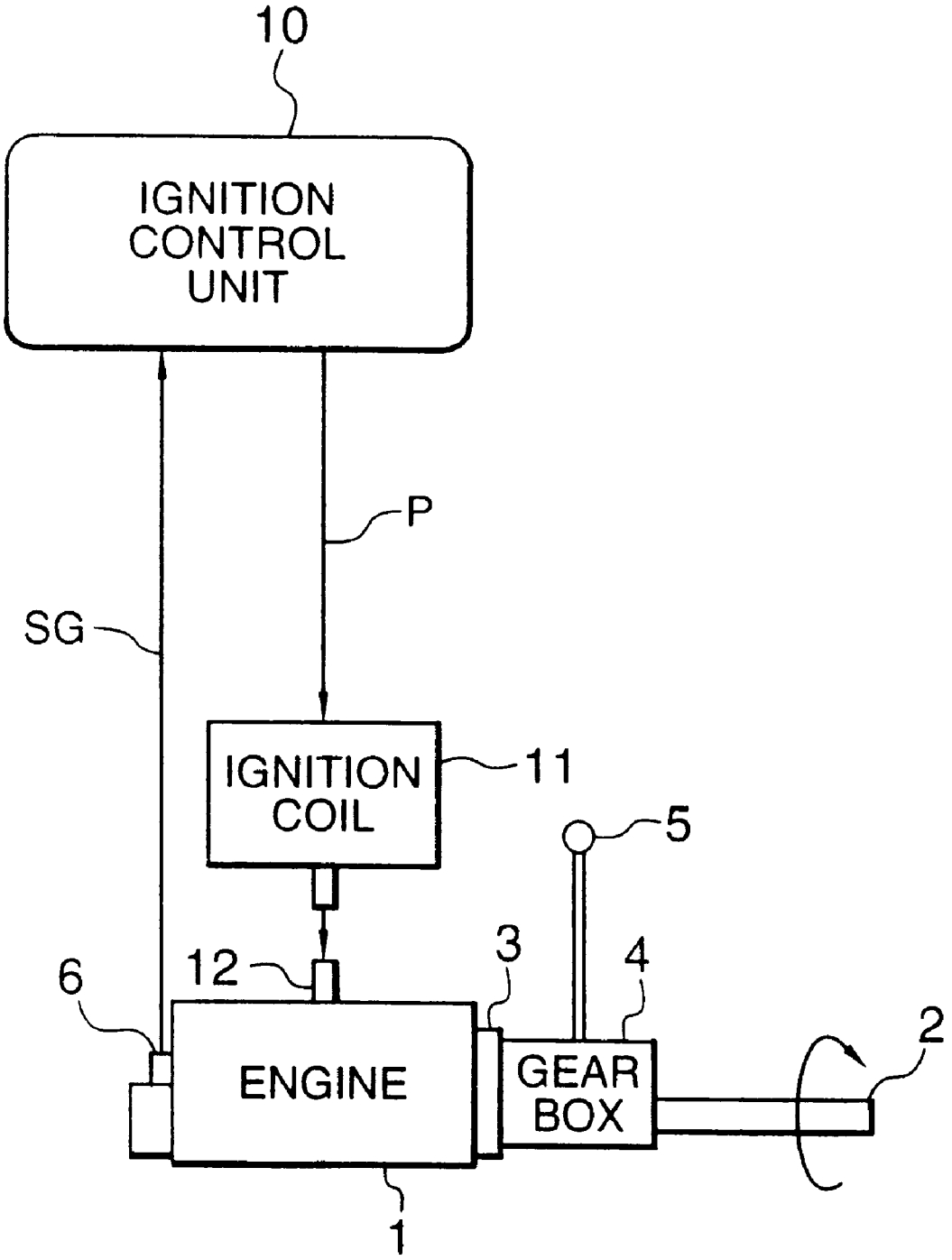
FIG. 4 is a block diagram showing schematically and generally a configuration of a two-cycle engine system equipped with a prior art reverse rotation control system for a motor vehicle in which a conventional gear box is employed.

Now, description will be made of a reverse control system according to a first embodiment of the present invention by reference to the drawings. FIG. 1 is a functional block diagram showing generally an arrangement of the reverse rotation control system and a two-cycle engine system according to the first embodiment of the invention. In the figure, components like as or equivalent to those described hereinbefore by reference to FIG. 4 are designated by like reference characters and repeated description in detail of these components is omitted.

Figure 2:
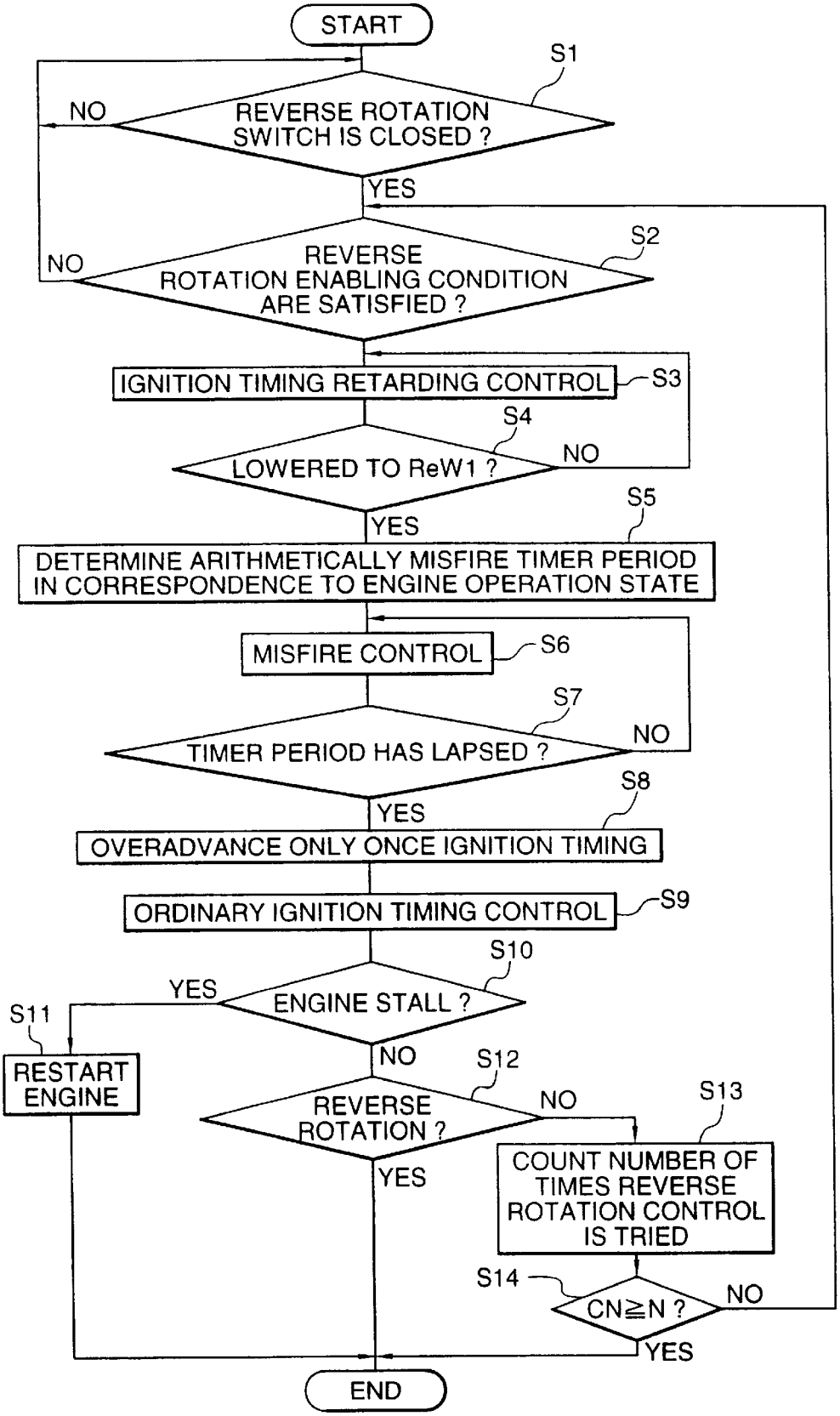
FIG. 2 is a flow chart for illustrating a reverse rotation control procedure executed by an ignition control unit incorporated in the system shown in FIG. 1.

FIG. 2 is a flow chart for illustrating operation of an ignition control unit 10A which constitutes a part of the reverse rotation control system according to the first embodiment of the invention and shows processing operations involved in reversing the rotation of the engine from the normal to reverse direction. At this juncture, it should be mentioned that essentially same procedure is adopted for restoring the normal rotation from the reverse rotation.

Figure 3:
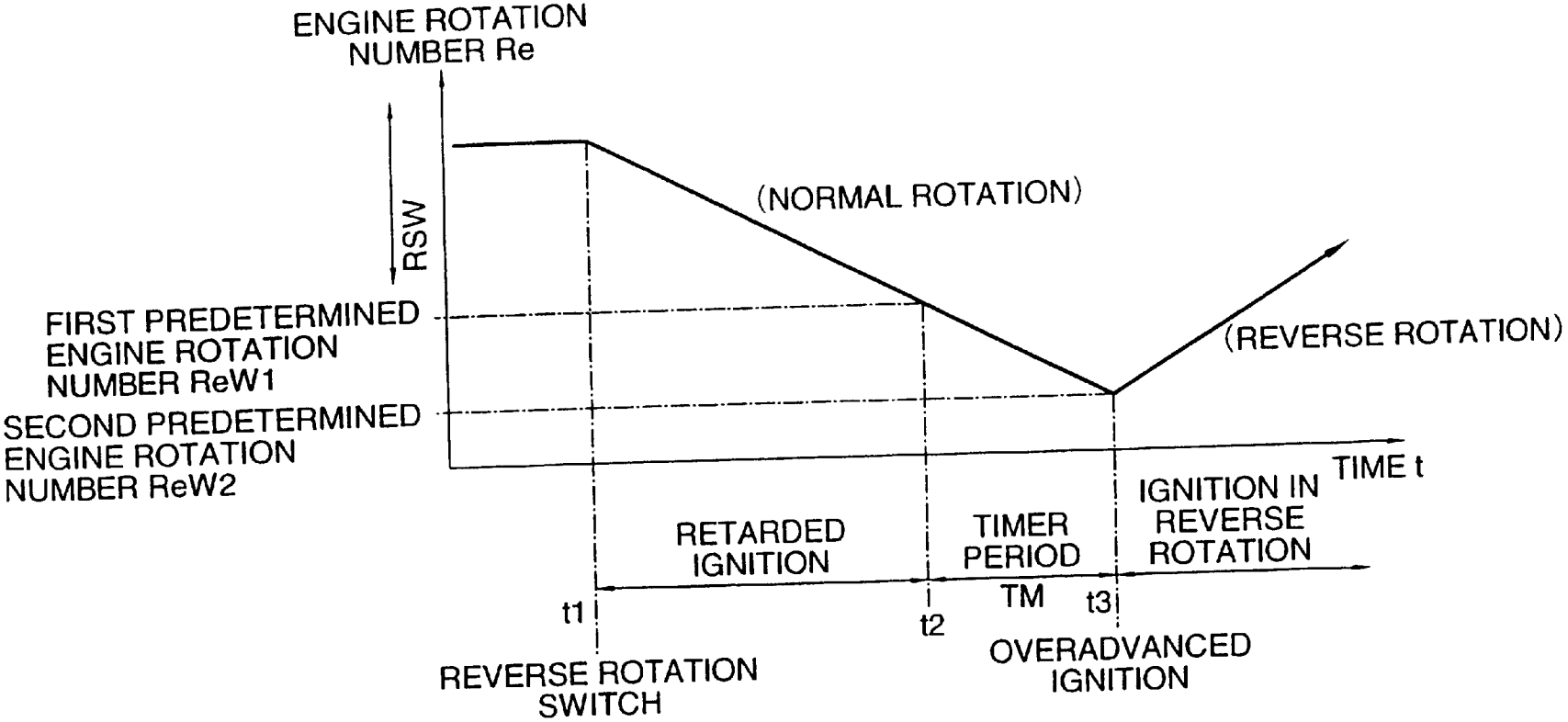
FIG. 3 is a timing chart for illustrating operation of a reverse rotation control according to the invention.

FIG. 3 is a timing chart for illustrating change of the engine rotation number Re during a reverse rotation control in the system according to the first embodiment of invention.

Referring to FIG. 3, an ignition timing retarding control is performed over a period from a timing point t1 for starting the reverse rotation control to a time point t2 when a first predetermined engine rotation number ReW1 is detected. On the other hand, a misfire control is carried out over a period from the time point t2 to a time point t3 at which a timer period TM (i.e., temporal period required for the engine rotation speed to lower to a second predetermined engine rotation number ReW2) is terminated. At the time point t3, an ignition signal P is applied whose ignition timing is overadvanced, whereby the rotation of the engine 1 is reversed.

Referring to FIG. 1, an ignition control unit 10A substantially corresponds to the ignition control unit 10 described hereinbefore by reference to FIG. 4 with exception that a control operation executing program differs in several respects.

Further, a centrifugal automatic transmission 3A corresponds to the clutch 3 described hereinbefore and it is implemented in the form of a V-belt transmission well known in the art. The engine 1 has an output shaft 2 which can be rotated exchangeably in either a forward direction or a reverse direction, as is indicated by a double-head arrow.

A rotating direction sensor 21 is provided in association with a rotatable shaft of the engine 1 for generating a rotating direction signal SD which indicates the rotating direction of the engine 1. Further provided is a temperature sensor 22 which is designed for detecting the temperature of cooling water of the engine 1 to output a water temperature signal TW which can be used as the engine temperature information. Parenthetically, wall temperature of the engine 1 may be employed as the engine temperature information. However, in the description which follows, it is assumed that the water temperature signal TW is used.

Further provided is a reverse rotation switch 23 which may be constituted by a push button switch for generating a reverse rotation command signal RW in response to manipulation of the push button switch by an operator or driver.

A brake switch 24 is so arranged as to output a brake signal B in response to brake applying operation performed by the driver.

On the other hand, an idle switch 25 is so arranged as to output an idle signal A indicating an idling operation state of the engine 1 (the state in which an acceleration pedal is released) in response to acceleration pedal releasing operation performed by the driver (i.e., operation for closing fully a throttle valve disposed within an intake pipe of the engine).

The rotating direction sensor 21, the water temperature sensor 22, the reverse rotation switch 23, the brake switch 24 and the idle switch 25 mentioned above constitute together with the rotation sensor 6 a set of the so-called various sensors which generate or output various information signals in correspondence to the operation states of the engine 1. The rotating direction signal SD, the water temperature signal TW, the reverse rotation command signal RW, the brake signal B and the idle signal A outputted from the sensors mentioned above are supplied as the operation state information to the ignition control unit 10A together with the rotation signal SG outputted from the rotation sensor 6.

Furthermore, a starter switch for starting the engine 1 is provided although it is not shown in FIG. 1. It goes without saying that a start signal generated in response to operation of this switch is equally inputted to the ignition control unit 10A upon starting of the engine 1.

Additionally, there are provided a normal rotation indicating lamp 26 and a reverse rotation indicating lamp 27 which are driven or electrically energized under the control of the ignition control unit 10A for indicating to the driver the direction in which the engine 1 is rotating currently (i.e., normal rotation or reverse rotation) and hence the traveling direction of the motor vehicle (i.e., forward or rearward). More specifically, the normal rotation indicating lamp 26 is energized only when the engine is rotating in the normal direction (usually corresponding to the forward traveling direction of the motor vehicle), while the reverse rotation indicating lamp 27 is lit only when the engine is rotating in the reverse direction.

The ignition control unit 10A includes an ignition timing retarding control means for causing the ignition timing for the engine 1 to retard beyond a top dead center in response to the input of the reverse rotation command signal RW, and an engine rotation number decision means for deciding whether or not the rotation number Re of the engine 1 is lowered to a first predetermined engine rotation number ReW1.

Further, the ignition control unit 10A includes a reverse rotation enabling condition decision means for making decision upon inputting of the reverse rotation command signal RW as to whether or not the engine operation state satisfies the conditions for enabling the engine rotation to be reversed. Only when these conditions for enabling the rotation to be reversed are satisfied, the ignition timing retarding control means is validated.

The ignition control unit 10A includes a misfire period arithmetic means for determining arithmetically a misfire-continuation period on the basis of the engine operation states when the engine rotation number Re has lowered to the first predetermined engine rotation number ReW1, a misfire means for causing misfire to occur in the engine 1 over the misfire period, and an overadvanced ignition signal generating means for outputting only once an ignition signal P at a time point overadvanced relative to an ordinary advanced ignition timing upon termination of the misfire period.

Furthermore, the ignition control unit 10A includes a normal ignition means for outputting an ordinary or normal ignition signal P in succession to the overadvanced ignition signal generated by the overadvanced ignition signal generating means, a reverse rotation decision means for deciding whether or not the engine 1 is in the reverse rotation state at the time point when the ordinary or normal ignition signal P is outputted, and a reverse rotation control repeating means for executing repetitively the reverse rotation control processing for the engine 1 until the reverse rotation state has been detected.

The reverse rotation enabling condition decision means incorporated in the ignition control unit 10A makes decision that the conditions for enabling the rotation of the engine to be reversed are satisfied to thereby validate the retarding control means only when the reverse rotation enabling conditions are met in the state in which the engine rotation number Re indicates the engine rotation number corresponding to the idling rotation number (800 to 2000 rpm) and in which both the brake signal B and the idle signal A are inputted.

In other words, in the ignition control unit 10A, the rotation signal SG, the brake signal B, the idle signal A and the start signal are utilized as the conditional information for allowing the control for reversing the rotation (also referred to as the reverse rotation control) of the engine 1 to be started.

In general, it is not preferred to validate the reverse rotation control in the state in which the motor vehicle is cruising (running steadily). Accordingly, the ignition control unit 10A is so designed or programmed that the reverse rotation control can not be executed even when the reverse rotation switch 23 is closed with the reverse rotation command signal RW being inputted to the ignition control unit 10A unless the conditions for allowing the engine 1 to be stopped (hereinafter also referred to also as the engine stopping conditions) are satisfied.

The retarding control means is designed to retard the ignition timing by a crank angle of 0° to 30° from the top dead center.

At this junction, it should be mentioned that the first predetermined engine rotation number ReW1 which determines the time point t2 at which the ignition timing retarding control is to be terminated is set to a rotation number which is lower than the idling rotation number of the engine 1 (e.g. a rotation number in a range of ca. 700 to 800 rpm).

The timer period TM during which the misfire control is performed continuously extends from the time point t2 to the time point t3 which follows the ignition timing retarding control period (the time points t1 to t2) and corresponds to the time period required for the engine rotation number Re to lower from the first predetermined engine rotation number ReW1 to the second predetermined engine rotation number ReW2.

The misfire period arithmetic means arithmetically determines the timer period TM during which the misfire control is performed continuously (i.e., the misfire period) on the basis of the rotation signal SG and the water temperature signal TW while the misfire control means causes the misfire event to take place in the engine 1 over the timer period TM.

The engine rotation number Re at the time point t3 at which the misfire control is terminated has been decreased to the second predetermined engine rotation number ReW2 which is lower than the first predetermined engine rotation number ReW1. The second predetermined engine rotation number ReW2 is set to a rotation number (e.g. a rotation number within a range of ca. 400 to 600 rpm) suited for the rotation reversing control.

In this way, the engine rotation number Re is lowered to the second predetermined rotation number ReW2 (ca. 500 rpm) at which the output torque is relatively low, and the ignition or firing is performed at a crank angle position advanced relative to the normal ignition timing during the piston stroke in the engine 1 toward the top dead center TDC, as a result of which a repulsing force is produced under the explosion of combustible mixture within the engine cylinder, whereby the reversion of the engine rotation is triggered.

Once the reverse rotation has been realized, the normal or ordinary ignition timing control is resumed for sustaining continuously the reverse rotation state through the normal ignition means. However, when the reverse rotation has been failed, the reverse rotation repeating means executes the reverse rotation processing repetitively.

In this conjunction, the reverse rotation repeating means includes a counter means for counting a number CN of times the reverse rotation control processing is repeated for thereby terminating the reverse rotation control processing at a time point when the repetition number CN has reached a predetermined rotation number N.

Next, referring to FIGS. 2 and 3, description will be directed to operation of the reverse rotation control system (or rotation reversing control system) according to the instant embodiment of the invention. As elucidated hereinbefore, rotation of the two-cycle engine 1 can be reversed by controlling the ignition timing.

In that case, the ignition control unit 10A carries out basic operations mentioned below. The crank angle position (i.e., angular position of the crank shaft) and the rotation number Re of the engine 1 are detected on the basis of the rotation signal SG while detecting the rotating direction of the engine 1 on the basis of the rotating direction signal SD, to thereby control the ignition timing in the forward rotation operation mode or in the reverse rotation operation mode.

Further, the ignition control unit 10A executes an intrinsic reverse rotation control operation mentioned below.

At first, in consideration of the conditions for starting the rotation reversing control, the ignition control apparatus 10A executes an ignition timing retarding control for lowering the engine rotation speed (rpm) Re only when the conditions for enabling the rotation reversing control to be started are satisfied. In succession, the ignition control apparatus 10A executes a misfire control for lowering further the engine rotation speed (rpm) Re by predicting arithmetically the timer period TM over which the misfire control is to be continued from map data on the basis of the engine temperature indicated by the water temperature TW mentioned previously.

It is assumed that upon starting of the engine 1, the engine 1 is rotated in the forward direction (also referred to as the normal direction) under the control of the ignition control unit 10A. Subsequently, the normal or ordinary ignition control is performed continuously by arithmetically determining the ignition timing in conformance with the prevailing engine operation state.

Now, let's assume that the driver manipulates the reverse rotation switch 23. Then, the reverse rotation command signal RW (which may also be referred to as the rotation reversing command signal) is then inputted to the ignition control unit 10A.

Referring to FIG. 2, the ignition control unit 10A monitors constantly whether the reverse rotation switch 23 is turned on (closed) or not (step S1). The rotation command signal RW is detected within a detectable range RSW of the engine rotation number Re (see FIG. 3).

When the reverse rotation command signal RW is inputted to the ignition control unit 10A, it is then decided in the step S1 that the reverse rotation switch 23 is closed (i.e., the decision step S1 results in affirmation or "YES"). Subsequently, in a succeeding step S2, the ignition control unit 10A decides whether or not the engine operation state at the time point t1 satisfies the reverse rotation enabling conditions.

As the conditions for enabling or validating the reverse rotation of the engine 1, there may be mentioned such conditions that the engine rotation number Re is lower than that in the ordinary running state or cruising state (e.g. lower than 2000 rpm inclusive), both the idle signal A and the brake signal B are inputted, the time lapse from the start of the engine 1 amounts to at least 2 seconds and others.

When it is decided in the step S2 that the reverse rotation enabling conditions are not met (i.e., when the decision step S2 results in negation or."NO"), the reverse rotation command signal RW being currently inputted is neglected, whereupon the processing resumes the step S1.

To this end, the ignition control unit 10A may be so programmed as not to start the reverse rotation control unless any one of the following conditions is met, i.e., the conditions that the engine rotation number Re determined on the basis of the rotation signal SG lies within a predetermined range of the idling rotation number (800 rpm to 2000 rpm), the brake signal B is inputted by way of the brake switch 24 in response to depression of the brake pedal by the driver and the idle signal A of on-state is inputted by way of the idle switch 25 with the acceleration pedal being released (with the throttle valve being fully closed).

Even if one of these conditions for enabling the reverse rotation mentioned above is not satisfied, the reverse rotation control is inhibited from being started because then the stability can not be ensured in driving the motor vehicle. In this way, maneuverability of the motor vehicle can be protected against degradation.

On the other hand, when decision is made in the step S2 that the reverse rotation enabling conditions are met (i.e., when the decision step S2 results in "YES"), the ignition control unit 10A effectuates the reverse rotation control or rotation reversing control.

By way of example, when the engine rotation number Re in the normal rotation mode (forward driving mode of the motor vehicle) is 1200 rpm after lapse of 2 seconds or more from the engine start (corresponding to the idle state) and when both the idle signal A and the brake signal B are inputted, the reverse rotation control is started in response to the input of the reverse rotation command signal RW.

At first, the ignition control unit 10A outputs the ignition signal P at a sufficiently retarded ignition timing for executing the ignition timing retarding control (step S3). More specifically, the ignition control unit 10A sets the ignition timing of the engine 1 to a retarded crank angle position (with a range of crank angle 0° to 30° after the top dead center TDC, hereinafter represented by ATDC 0° to 30° or so) at which the engine rotation number Re can be lowered sufficiently from the current advanced state (e.g. crank angle position of 5° to 30° before the top dead center TDC, hereinafter also represented by BTDC 5° to 30°).

By setting the ignition timing within the range of ATDC 0° to 30° in terms of the crank angle in the idling state in this way, the output torque becomes low, being accompanied with rapid decreasing of the engine rotation number Re in the case of the two-cycle engine (see FIG. 3).

In that case, the ignition control unit 10A monitors constantly the engine rotation number Re for making decision whether or not the engine rotation number Re has lowered to the first predetermined engine rotation number ReW1 (step S4) while performing the ignition timing retarding control up to the time point t2 at which the engine rotation number Re has lowered to the first predetermined engine rotation number ReW1 (e.g. 700 to 800 rpm) in the step S3.

When the output torque of the crank shaft of the engine 1 becomes sufficiently low through the ignition timing retarding control (step S3), then decision is made in a step S4 that the engine rotation number Re has lowered to the first predetermined engine rotation number ReW1. In other words, output of the decision step S4 is affirmative "YES".

Subsequently, in a step 5, the misfire control means determines arithmetically a timer period TM for which the misfire control is to be continued from the map data corresponding to the engine operation state at the time point t2 at which the engine rotation number Re has lowered to the first predetermined engine rotation number ReW1, to thereby suppress the ignition signal P in order to start the misfire control in a step 6.

The misfire state mentioned above is sustained over the timer period TM determined arithmetically, starting from the time point t2.

In this conjunction, it is to be noted that data for the timer period TM is previously stored in a memory incorporated in the ignition control unit 10A in the form of map data, and thus the timer period TM is determined from the map data as the predicted or estimated time which will be required for the engine speed to lower to the second predetermined engine rotation number ReW2 (600 rpm to 400 rpm) optimal for reversing the rotation of the engine while taking into account the engine temperature (water temperature TW) at the time point t2.

Thus, the timer period TM is set relatively longer when the engine rotation number Re is high, because a relative long time will then be taken for the rotation speed of the engine to decrease to the predetermined engine rotation speed. Similarly, the timer period TM is set to be relatively longer when the engine temperature (water temperature TW) is high because the engine 1 is then in the sufficiently warmed-up state.

In this way, the map data for the timer period TM is corrected or modified in consideration of the engine state (indicated by the temperature information derived from the output of the temperature sensor 22) to be thereby set optimal for lowering the engine rotation speed (rpm) to the predetermined value for validating the rotation reversing ignition timing control. Thus, the engine rotation reversing control operation can be effectuated essentially without fail.

So long as the misfire control (step S6) is being effected, the engine rotation number Re continues to lower, as can be seen in FIG. 3.

In that case, the ignition control unit 10A monitors constantly the engine rotation number Re for making decision whether the timer period TM has lapsed or not (step S7) and continues the misfire control (step S6) until the timer period TM has lapsed.

In this manner, in precedence to the start of the overadvanced ignition for triggering the reverse rotation of the engine, the ignition timing retarding control for lowering the engine rotation number Re is performed consecutively over the timer period TM from the time point t1 to the time point t2, whereby the engine rotation number Re is lowered to the first predetermined engine rotation number ReW1, whereon the misfire control is carried out over the timer period TM from the time point t2 to the time point t3, which results in that the engine rotation number is further lowered to the second predetermined rotation number ReW2 which is suited for realizing the overadvanced ignition timing.

In this conjunction, it should be appreciated that since the misfire period (timer period TM) is set immediately before performing the overadvanced ignition for reversing the engine rotation, the engine rotation number Re can be converged to the second predetermined engine rotation number ReW2 with high accuracy.

Thus, it can duly be expected that the torque of the crank shaft of the engine 1 is sufficiently decreased at the time point t3 (see FIG. 3) when the timer period TM for the misfire control is terminated and that the engine rotation number Re is lowered to the second predetermined engine rotation number ReW2.

At this juncture, it should be mentioned that in the case of the two-cycle engine 1, unburned gas and exhaust gas coexist mixedly when the engine rotates at a low speed. Consequently, an attempt for decreasing the engine rotation number Re only through the ignition timing retarding control will incur instability of the combustion state. In contrast, by setting the misfire period when the engine rotation speed is low for the purpose of lowering the engine rotation number Re without performing extraneous ignition, as described above, the concentration of the unburnt gas within the combustion chamber of the engine will increase due to repetition of the suction stroke and the exhaust stroke, whereby there can be realized sufficiently stable state of the gas mixture ultimately at the time point for the overadvanced ignition.

When it is decided in the step S7 that the timer period TM has lapsed from the start of the misfire control (step S4) (i.e., when the decision step S7 results in "YES"), the ignition control unit 10A generates only once the ignition signal P set at an overadvanced crank angle (within a range of BTDC 30° to BTDC 60° or so) relative to the ordinary advanced ignition timing (which lies usually within a range of BTDC 5° to BTDC 30°) (step S8).

By firing the combustible mixture within the engine cylinder only once at the overadvanced ignition timing (e.g. within a range of BTDC 30° to BTDC 60°) during the piston stroke toward the top dead center TDC, reverse rotation of the engine is started, being triggered by the explosion taken place within the cylinder.

Once the reverse rotation has been started, then the engine control is performed in continuation through the ordinary ignition timing control by regarding the reverse rotation mode as the normal rotation mode (step S9). Consequently, the engine rotation number Re of the engine 1 increases in the reverse rotation mode as well, as can be seen in FIG. 3. It should however be mentioned that rotation of the engine 1 can not always be reversed in the step S9.

Accordingly, in succession to the step S9, the ignition control unit 10A makes decision in a step S10 as to whether the stall of the engine 1 takes place or not. When the stall occurs (i.e., when the result of the decision step S10 is "YES"), the engine 1 is restarted in a step S11, whereupon the processing illustrated in FIG. 2 is ended.

On the other hand, when it is decided in the step S10 that no engine stall occurs (i.e., when the output of the decision step S10 is "NO"), then a step S12 is executed for deciding whether or not the engine 1 is rotating in the reverse direction on the basis of the rotation signal SG (crank angle signal) and the rotating direction signal SD.

When it is decided in the step S12 that the engine is currently rotating in the reverse direction (i.e., when the output of the step S10 is "YES"), the ignition control unit 10A deenergizes the normal rotation indicating lamp 26 while lighting the reverse rotation indicating lamp 27 to inform the driver that the rearward driving of the motor vehicle is now validated, whereupon the processing illustrated in FIG. 2 comes to an end.

On the other hand, when it is decided in the step S10 that the engine 1 is rotating in the normal or forward direction because of failure in reversing the engine rotation (i.e., when the decision step S12 results in "NO"), this means that the engine 1 is rotating in the ordinarily normal direction (forward direction). Thus, there arises necessity of executing again the reverse rotation control processing.

In that case, the ignition control unit 10A counts the number of the times the reverse rotation control is tried by incrementing a corresponding counter value CN in a step S13 and makes decision as to whether or not the counter value CN has reached a predetermined value N (e.g. three) in a step S14.

When it is decided in the step S14 that the reverse rotation control processing was repeated a predetermined number of times N and that the counter value CN is equal to or greater than the predetermined value N (i.e., when the answer of the step S11 is "YES"), then the processing shown in FIG. 2 is terminated by regarding that attempt for realization of the reverse rotation control will end in vain. In this way, useless repetition of the reverse rotation control validating process is prevented.

As is apparent from the above, when the reverse rotation of the engine can not be realized within the predetermined number (N) of the repetitions, the ordinary engine control in the forward driving direction is restored without repeating any further attempt for realizing the reverse rotation control in vain, whereon the ignition control unit 10A is reset to the state waiting for the reverse rotation command issued upon actuation of the reverse rotation switch 23.

When the decision in the step S14 results in that CN<N (i.e., when the step S11 results in negation or "NO"), the reverse rotation condition decision step S2 is resumed, whereon attempt for enabling or validating the reverse rotation control described above is repeated. The number N of times the reverse rotation control processing can be tried may be set to e.g. three. In this manner, validation of the reverse rotation control is automatically tried again with the ignition timing having been retarded to the ordinary ignition timing.

At this juncture, it should be added that the conditions for enabling the reverse rotation control are checked even in the course of the reverse rotation control so that the reverse rotation control processing can be reset immediately when any one of the previously mentioned conditions for enabling the reverse rotation control is not satisfied due to releasing of the brake and/or actuation of the acceleration pedal, whereby the ordinary engine control in the forward direction is resumed.

In that case, the ignition control unit 10A performs the control for preventing the runaway of operation of the centrifugal automatic transmission 3A after releasing the rotation reversing control and validates the ordinary control when the conditions for changing over the reverse rotation to the forward or normal rotation are satisfied. The changeover of the engine operation from the reverse rotation control state (rearward driving of the motor vehicle) to the normal rotation state (forward driving of the motor vehicle) can be realized by executing the control processing procedure illustrated in FIG. 2 by regarding the reverse rotation mode prevailing currently as the normal mode.

As is shown in FIG. 2, by performing the ignition timing retarding control for lowering the engine rotation number Re in precedence to the start of the overadvanced ignition in order to lower the engine rotation number Re to the first predetermined engine rotation number ReW1 and then performing the misfire control to thereby decrease further the engine rotation number to the second predetermined rotation number ReW2, rotation of the engine 1 can be reversed positively without incurring degradation in the quality of exhaust gas as well as in the combustion performance of the engine.

More specifically, because the engine rotation number (Re) is lowered during the period from the time point t1 to the time point t2 through the ignition timing retarding control, discharge of the unburnt gas can be suppressed, whereby degradation of the exhaust gas composition can be prevented and at the same time deposition of fuel onto the spark plug 12 can be prevented, as a result of which the ignition performance of the engine 1 can be protected against degradation.

Besides, because the ignition timing is retarded by 0° to 30° in terms of the crank angle from the top dead center through the ignition timing retarding control, the engine rotation number can be decreased without fail.

As is apparent from the foregoing, according to the teachings of the present invention incarnated in the illustrated embodiment, the reverse rotation of the engine can be realized by employing the inexpensive centrifugal-type automatic transmission 3A without resorting to the use of the expensive gear box 4 (see FIG. 4), and thus the peripheral space of the engine 1 can be decreased, which means that the whole engine system and hence the motor vehicle can be implemented inexpensively in a small size. Besides, power as well as maneuverability of the motor vehicle equipped with the engine according to the invention can be effectively enhanced because of possibility of implementing the engine 1 in light weight.

Furthermore, by setting the timer period TM for the misfire period for allowing the engine rotation number Re to decrease to the second predetermined rotation number ReW2 for effectuating the overadvanced ignition without need for constantly monitoring the engine rotation number Re, reversing of the engine rotation can be realized without incurring any appreciable increase in the cost.

Besides, because the engine rotation number Re is decreased in advance through the ignition timing retarding control, the timer period TM for the misfire period (from the time point t1 to the time point t2) can be set short, whereby the engine rotation number Re can be converged to the second predetermined engine rotation number ReW2 at the end of the misfire period without fail.

Because the timer period TM is previously determined arithmetically or predicted on the basis of the engine operation state prevailing when the misfire control is started, the engine rotation number Re can be decreased to the second predetermined engine rotation number ReW2 at the end of the timer period with high reliability.

Additionally, because the misfire control is performed immediately in precedence to the overadvanced ignition, the state of the gas mixture within the combustion chamber can be stabilized. Thus, with the pulse ignition signal P applied at the overadvanced ignition timing t3, the engine rotation can be reversed with high reliability.

Furthermore, by setting the conditions such as the engine rotation number corresponding to the idling state and the others for allowing the misfiring process to be started for enabling the reverse rotation control, as described hereinbefore, the reverse rotation control processing can be started only when the reverse rotation enabling conditions are met. Besides, upon occurrence of failure in reversing the engine rotation, the reverse rotation control processing can be repeated, which contributes to enhancing the reliability in reversing the engine rotation.

Additionally, because the ignition control unit 10A is so arranged as to light the reverse rotation indicating lamp 27 while deenergizing the normal rotation indicating lamp 26 when the engine rotation is reversed, information indicating that the motor vehicle can be driven rearwardly or backwardly is made available for the driver.

Embodiment 2

In the case of the reverse rotation control system according to the first embodiment of the invention, the timer period TM is set as the misfire period. In the reverse rotation control system according to a second embodiment of the invention, the number of times the misfire is caused to take place is set in place of the timer period TM.

To this end, the misfire period arithmetic means incorporated in the ignition control unit 10A is so designed or programmed as to predict arithmetically the number of times the misfire event occurs in correspondence to the operation state of the engine. Further, the misfire means causes the engine misfire event to occur a number of times arithmetically determined on the basis of the map data mentioned hereinbefore. By way of example, the misfire means may be so implemented that the misfire can take place over a period corresponding to two rotations of the engine 1.

By way of example, the number of times the misfire event occurs may be so set as to fall within a range of twice to four times during a period corresponding to two rotations of the engine in dependence on the engine operation state (indicated by the engine temperature or the like) prevailing when the misfire is to be started.

By virtue of the feature of the reverse rotation control system according to the second embodiment of the present invention described above, the arithmetic processing for controlling the misfire event can be significantly simplified when compared with the misfire control to be performed constantly over the preset timer period.

Many modifications and variations of the present invention are possible in the light of the above techniques. It is therefore to be understood that within the scope of the appended claims, the invention may be practiced otherwise than as specifically described.

What is claimed is:

1. A reverse rotation control system for a two-cycle engine mounted on a motor vehicle, comprising:

a variety of sensors for generating a variety of information signals in correspondence to engine operation states; and an ignition control unit for outputting an ignition signal for said engine on the basis of said variety of information signals, said variety of sensors including at least a rotation sensor for outputting a rotation signal corresponding to rotation of said engine and a reverse rotation switch for generating a reverse rotation command signal for reversing engine rotation, said ignition control unit including:

ignition timing retarding control means for causing ignition timing of said engine to retard beyond a top dead center upon inputting of said reverse rotation command signal;

engine rotation number decision means for deciding whether or not rotation number of said engine is lowered to a first predetermined engine rotation number;

misfire period arithmetic means for determining arithmetically a misfire period on the basis of said engine operation states when said engine rotation number is lowered to a first predetermined engine rotation number;

misfire means for causing misfire to occur in said engine over said misfire period; and overadvanced ignition means for outputting only once an ignition signal overadvanced relative to an ordinary advanced ignition timing upon termination of said misfire period, wherein said misfire period corresponds to a time period required for said engine rotation number to lower from said first predetermined engine rotation number to a second predetermined engine rotation number, wherein said first predetermined engine rotation number is set at a value smaller than an idling rotation number of said engine, and wherein said second predetermined engine rotation number is set at a value which is smaller than said first predetermined engine rotation number and which is suited for the reverse rotation control.

2. A reverse rotation control system for a two-cycle engine of a motor vehicle according to claim 1, wherein said ignition timing retarding control means makes the ignition timing retard by a crank angle of 0° to 30° from the top dead center.

3. A reverse rotation control system for a two-cycle engine of a motor vehicle according to claim 1, wherein said misfire period arithmetic means determines arithmetically a timer period as said misfire period for allowing misfire to occur in continuation, and wherein said misfire control means causes misfire to occur in said engine over said timer period.

4. A reverse rotation control system for a two-cycle engine of a motor vehicle according to claim 1, wherein said misfire period arithmetic means determines arithmetically a number of times misfire is to occur as said misfire period, and wherein said misfire control means causes misfire to occur in said engine only said number of times.

5. A reverse rotation control system for a two-cycle engine of a motor vehicle according to claim 1, said ignition control unit including:

reverse rotation condition decision means for making decision upon inputting of said reverse rotation command signal as to whether or not said engine operation state satisfies reverse rotation enabling conditions, wherein said ignition timing retarding control means is validated only when said reverse rotation enabling conditions are satisfied.

6. A reverse rotation control system for a two-cycle engine of a motor vehicle according to claim 1, said ignition control unit including:

normal ignition means for outputting a normal ignition signal in succession to an overadvanced ignition signal generated by said overadvanced ignition signal generating means;

reverse rotation decision means for deciding whether or not said engine is in a reverse rotation state at the time point when said normal ignition signal is outputted; and reverse rotation repeating means for executing repetitively reverse rotation control processing for said engine until said reverse rotation state is validated.

7. A reverse rotation control system for a two-cycle engine of a motor vehicle according to claim 6, said reverse rotation repeating means including counter means for counting a number of times said reverse rotation control processing is repeated, wherein said reverse rotation control processing is terminated at a time point when said repeating number has attained a predetermined number.

8. A reverse rotation control system for a two-cycle engine of a motor vehicle according to claim 1, further comprising:

a normal rotation indicating lamp; and a reverse rotation indicating lamp, wherein said both lamps are driven under the control of said ignition control unit such that said normal rotation indicating lamp is energized only when said engine is rotating in a normal direction, while said reverse rotation indicating lamp is lit only when said engine is rotating in a reverse direction.

9. A reverse rotation control system for a two-cycle engine mounted on a motor vehicle, comprising:

a variety of sensors for generating a variety of information signals in correspondence to engine operation states, said variety of sensors including a brake switch for generating a brake signal upon braking operation; and an idle switch for generating an idle signal when an acceleration pedal is released, wherein said reverse rotation enabling condition decision means decides that said reverse rotation enabling conditions are met when said engine rotation number indicates an engine rotation number corresponding to the idling rotation number and when both of said brake signal and said idle signal are inputted; and an ignition control unit for outputting an ignition signal for said engine on the basis of said variety of information signals, said variety of sensors including at least a rotation sensor for outputting a rotation signal corresponding to rotation of said engine and a reverse rotation switch for generating a reverse rotation command signal for reversing engine rotation, said ignition control unit including:

ignition timing retarding control means for causing ignition timing of said engine to retard beyond a top dead center upon inputting of said reverse rotation command signal;

engine rotation number decision means for deciding whether or not rotation number of said engine is lowered to a first predetermined engine rotation number;

misfire period arithmetic means for determining arithmetically a misfire period on the basis of said engine operation states when said engine rotation number is lowered to a first predetermined engine rotation number;

misfire means for causing misfire to occur in said engine over said misfire period;

overadvanced ignition means for outputting only once an ignition signal overadvanced relative to an ordinary advanced ignition timing upon termination of said misfire period; and reverse rotation condition decision means for making decision upon inputting of said reverse rotation command signal as to whether or not said engine operation state satisfies reverse rotation enabling conditions, wherein said ignition timing retarding control means is validated only when said reverse rotation enabling conditions are satisfied, wherein said misfire period corresponds to a time period required for said engine rotation number to lower from said first predetermined engine rotation number to a second predetermined engine rotation number, wherein said first predetermined engine rotation number is set at a value smaller than an idling rotation number of said engine, and wherein said second predetermined engine rotation number is set at a value which is smaller than first predetermined engine rotation number and which is suited for the reverse rotation rotation control.

10. A reverse rotation control system for a two-cycle engine mounted on a motor vehicle, comprising:

a variety of sensors for generating a variety of information signals in correspondence to engine operation states, said various sensors further including a temperature sensor for outputting a temperature information signal indicating temperature of said engine, wherein said misfire period arithmetic means determines arithmetically said misfire period on the basis of said rotation signal and said temperature information signal; and an ignition control unit for outputting an ignition signal for said engine on the basis of said variety of information signals, said variety of sensors including at least a rotation sensor for outputting a rotation signal corresponding to rotation of said engine and a reverse rotation switch for generating a reverse rotation command signal for reversing engine rotation, said ignition control unit including:

ignition timing retarding control means for causing ignition timing of said engine to retard beyond a top dead center upon inputting of said reverse rotation command signal;

engine rotation number decision means for deciding whether or not rotation number of said engine is lowered to a first predetermined engine rotation number;

misfire period arithmetic means for determining arithmetically a misfire period on the basis of said engine operation states when said engine rotation number is lowered to a first predetermined engine rotation number;

misfire means for causing misfire to occur in said engine over said misfire period; and overadvanced ignition means for outputting only once an ignition signal overadvanced relative to an ordinary advanced ignition timing upon termination of said misfire period, wherein said misfire period corresponds to a time period required for said engine rotation number to lower from said first predetermined engine rotation number to a second predetermined engine rotation number, wherein said first predetermined engine rotation number is set at a value smaller than an idling rotation number of said engine, and wherein said second predetermined engine rotation number is set at a value which is smaller than first predetermined engine rotation number and which is suited for the reverse rotation rotation control.

* * * * *